United States Patent [19]

Burns

[11] Patent Number: 4,707,044

[45] Date of Patent: Nov. 17, 1987

[54] BUTT CONTACTS FOR AN ELECTRICAL CONNECTOR

[75] Inventor: Edgar Burns, Los Angeles, Calif.

[73] Assignee: G & H Technology, Inc., Santa Monica, Calif.

[21] Appl. No.: 889,943

[22] Filed: Jul. 28, 1986

[51] Int. Cl.[4] ..... H01R 25/00

[52] U.S. Cl. ..... 439/289; 439/848

[58] Field of Search ..... 339/48, 49, 256 R, 256 S, 339/253 R, 255 R, 252 S

[56] References Cited

U.S. PATENT DOCUMENTS

| | | | |
|---|---|---|---|
| 1,392,558 | 10/1921 | Darrah et al. | 339/48 |
| 3,771,110 | 11/1973 | Reed | 339/48 |
| 4,572,606 | 2/1986 | Neumann et al. | 339/256 R |

*Primary Examiner*—Gil Weidenfeld
*Assistant Examiner*—Paula A. Austin
*Attorney, Agent, or Firm*—George J. Netter

[57] ABSTRACT

One end of an electrical connector first contact is a metallic cylinder which is hollow to receive a cable wire for soldered or crimping securement. A second contact has a body portion constructed substantially the same as the first contact except that its pin end is faced off to a flat surface. A hollow cylindrical metal shell with one closed end and a flanged open end is slidingy received on the body portion other cylindrical end. Mating engagement of the connector parts brings the radiused pin end of the first contact into pressurizing connection with the second contact metal shell establishing the desired connection. Unmating may be accomplished by either axial or transverse relative movement of the connector parts. In a further embodiment the hollow cylindrical metal shell has one or more inwardly formed spring fingers that slide over the enlarged head during assembly and prevent inadvertent removal of the shell from the rest of the contact.

6 Claims, 8 Drawing Figures

BUTT CONTACTS FOR AN ELECTRICAL CONNECTOR

The present invention relates generally to contacts for use in a releasable electrical connector, and, more particularly, to improved butt contacts which can be disconnected by relative movements in either axial or transverse directions.

BACKGROUND

Releasable electrical connectors typically includes a pair of connector parts, each of which have one or more contacts connected to cable wires. In the usual case, the contacts are male and female (i.e., pins and socket) in which the male contact fits into an opening in the female contact, and which can only be mated or unmated by relative movement along a single axis, movements in other directions causing damage to or destruction of the contacts.

There are many situations (e.g. missile launches) in which it is desirable to be able to release or unmate a connector by exerting forces along any of several different directions. So-called "butt" contacts are known which establish electrical interconnection by mere surface contact between the contacts and no parts of either contact are entrapped or secured within the other contact. Such butt contacts are separable by relative contact movement in several directions without damaging or breaking the contacts or the connector parts.

OBJECTS AND SUMMARY OF THE DESCRIBED EMBODIMENTS

A primary aim and object is the provision of butt contacts which are individually spring mounted resiliently urging the contacts along an axial direction.

A further object is the provision of such contacts which are secured within a connector part against withdrawal other than by the use of special tools.

Yet another object is the provision of a butt contact which automatically shields the unmated connector part within which the contact is mounted against external electromagneetic interference fields.

According to a first embodiment of the invention first and second contacts are mounted within respective connector parts of a releasable connector and abut against one another on mating of the connector parts to establish electrical connection therebetween. The rear portion of the first contact is a metallic cylinder, one end of which is hollow to receive a cable wire therewithin for soldered or crimping securement. The other cylinder end is radiused and can be slotted with an enlarged flange located intermediate the ends. The first contact is locked within an opening in an insulative insert mounted within the connector part by spring metal fingers engaging the flange. When so-positioned the slotted, radiused contact end extends outwardly of the connector part insert.

The second contact includes a body portion constructed substantially the same as the first contact except that its other cylindrical end may be faced off to a flat surface and it is unslotted. A hollow cylindrical metal shell with one closed end and a flanged open end is slidingly received on the body portion other cylindrical end. An annular spring washer or other spring means between the body portion flange and metal shell provides resiliency to the metal shell movement.

Mating engagement of the connector parts brings the radiused split end of the first contact into pressurizing connection with the second contact metal shell establishing the desired connection. Unmating may be accomplished by either axial or transverse relative movement of the connector parts.

In a further embodiment the first contact can be constructed as in the first described embodiment. The second contact body portion is similar to that of the first described embodiment except that the other cylinder end has an enlarged head with rearwardly facing shoulder. A hollow cylindrical metal shell has one or more inwardly formed spring fingers that slide over the enlarged head during assembly and prevent inadvertent removal of the shell from the rest of the contact.

In a still further aspect, the annular spring urges the metal shell into shielding contact with a grid plate opening edge to isolate the connector interior from ambient interference fields.

DESCRIPTION OF PREFERRED EMBODIMENTS

Figure 1:
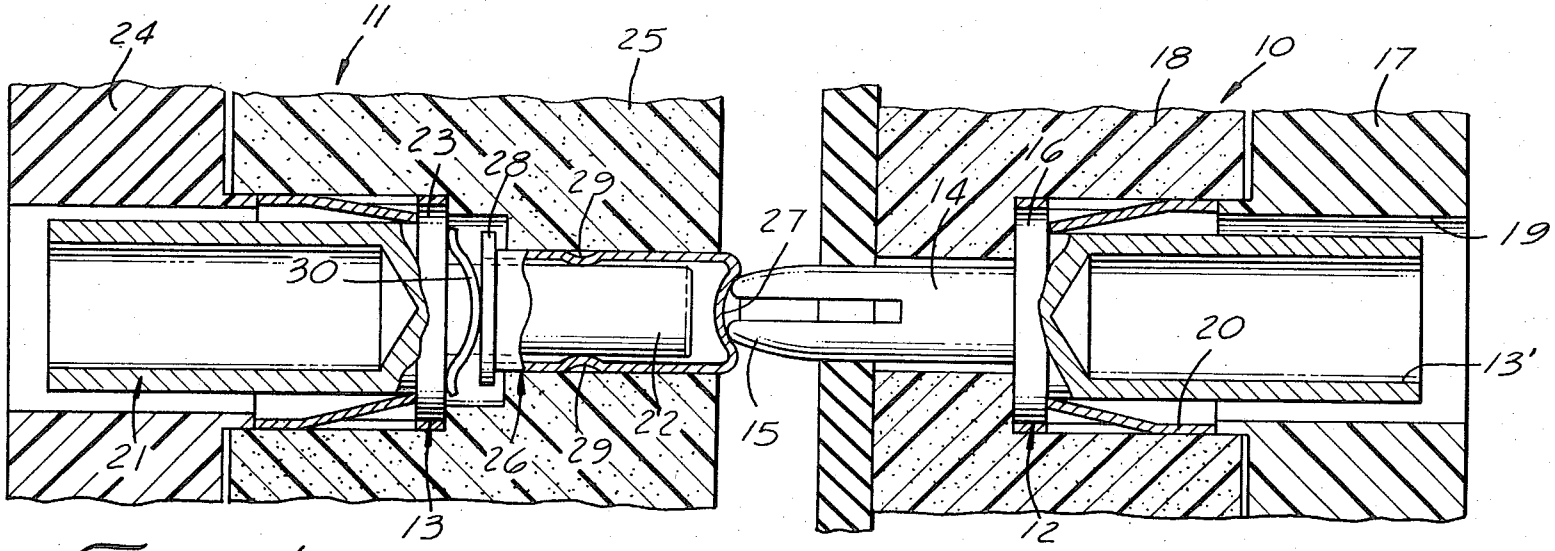
FIG. 1 is a side elevational, sectional view of a mated connector with a first form of butt contacts of the invention.
Figure 2:
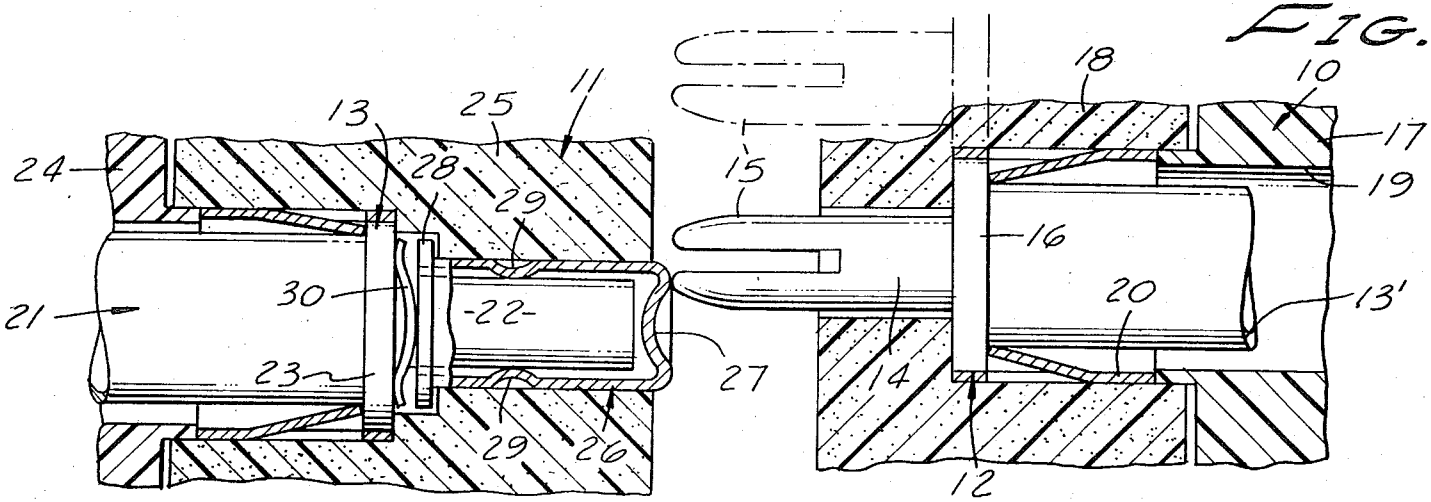
FIG. 2 is a view similar to FIG. 1 showing the connector in process of being unmated.
Figure 3:
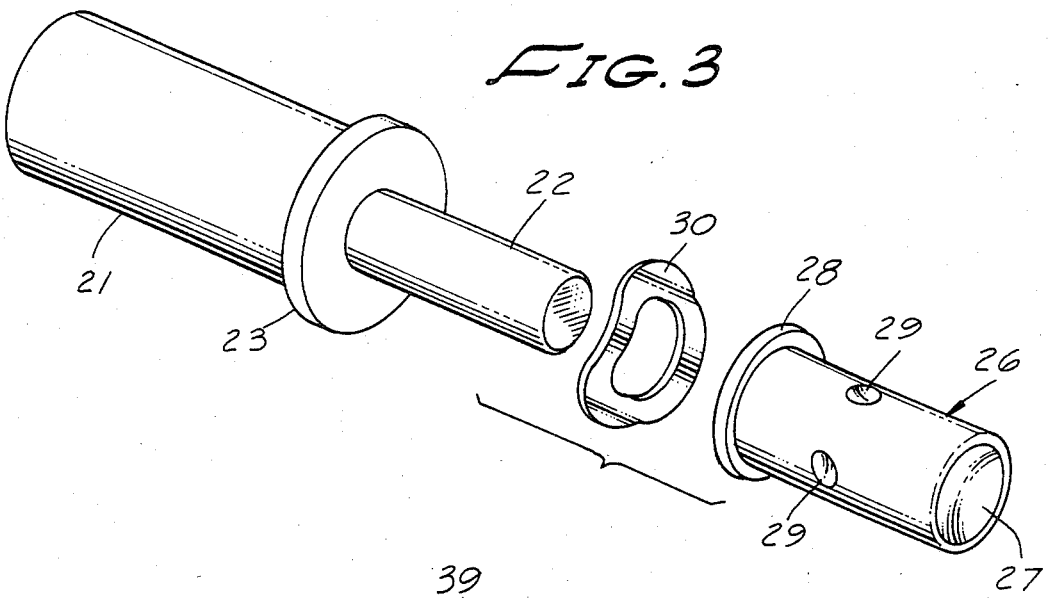
FIG. 3 is an exploded view of one of the butt contacts of FIGS. 1 and 2.

Reference is now made to the drawings and particularly FIGS. 1 and 2 where first and second electrical connector parts 10 and 11 only partially depicted are, in a way well-known in the art, releasably interconnected to one another in order to effect electrical connection between one or more cable wires. The cable wires to be connected are either crimped or soldered to contacts 12 and 13 which are brought into electrical connection with each other on mating of the connector parts 10 and 11. As will be made clear, the contacts 12 and 13 are of the butt variety having the advantageous feature that they may be disconnected or unmated by relative movement of the connector parts 10 and 11 either along the axis of the two contacts or by transverse relative motion between them.

The first contact 12 is a generally elongated cylindrical member having at one end 13' an opening for receiving a cable wire therewithin which may be crimped or soldered, as desired. The other member end has a reduced diameter pin 14 extending axially with the hollowed end 13' and terminating in a radiused tip 15 which is also slotted giving the pin transverse resiliency for a purpose to be described. Separating the hollow end from the pin 14 is an enlarged flange 16. In assembly within the connector part 10, such a connector part typically includes an outer metal shell (not shown)

within which plastic inserts 17 and 18 are located having an opening 19 therethrough of sufficient size to receive the contact 12 therewithin. Annular spring means 20 received within opening 19 have inwardly directed fingers which engage the flange backside and hold the contact 12 in place with the pin 14 firmly extending from the front face of insert 18.

The second contact 13 includes a part 21 similar to the contact 12 in having a tubular metal portion within which a cable wire can be crimped or soldered and a cylindrical pin 22 of reduced diameter which differs from the pin 14 in having a faced-off end. Also, an enlarged flange 23 separates the pin 22 from the hollow tubular end and serves as a means for locking the entire contact 13 within inserts 24 and 25. An annular wave washer 30 of spring-like material is received on the pin 22 and abuts against the outer face of the flange 23.

A hollow metal sleeve 26 has one open end and a closed end, the latter having its outer end face formed into a curved axially outwardly facing concavity 27. A radially outwardly extending flange 28 defines the open end of the shell 26. One or more dimples or spring fingers 29 in the sidewall of the shell 26 allow the shell 26 to provide a close and sliding fit on the pin 22 establishing electrical continuity between the sleeve and the contact. The opening in the insert 25 has a shoulder which engages the flange 28 of the shell 26 preventing the shell from being moved forwardly out of the insert. Otherwise, the shell 26 can be moved towards the flange 23 compressing a wave washer spring 30.

During mating, the two connector parts 10 and 11 are moved toward one another bringing the radiused end 15 of the first contact pin 14 into the concavity 27 effecting a certain amount of movement of the shell 29 against the wave washer spring 30 placing it in compression. At this time there is a direct electrical connection from the cable connected to the contact 12 and through the contact 13 to the cable connected therewith.

As shown in FIG. 2, not only may the connector be disconnected or unmated by axial movement reverse to that to produce mating, but the connector part 12 may be moved transversely to the dashed line position which also disconnects the two contacts and does so without damaging either of the contacts or the other connector apparatus. At this time slight sleeve movement against the spring aids in the transverse releasing of the connection.

Figure 4:
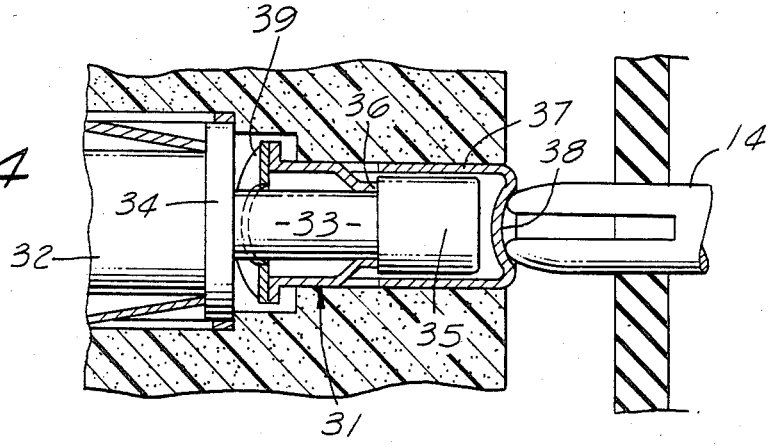
FIG. 4 is a side elevational, sectional view of an alternative butt contact.

Another embodiment of the invention consists in modifying the second contact to the form shown in FIG. 4 as 31 which coacts with a further contact that can be identical to the contact 12 in the first described embodiment. As before, the contact 31 includes a hollow tubular portion 32 within which a cable wire is connected and a pin-like portion 33 coaxial with the hollow member 32. A circular flange 34 is located between the two portions 32 and 33 and the latter terminates in an enlarged head 35. The diameter of the head 35 is greater than that of the pin 33 forming a shoulder 36 therebetween. A hollow metal shell 37 has a closed end which is curved at 38 for receiving the end of pin 14 during mating. The opposite end of the shell 37 is open and has an edge flange that extends radially outwardly therefrom. Parts of the shell sidewalls are broken and deformed inwardly to lock behind the head shoulder 36 as well as contact the pin-like portions 33. Prior to assembling the head portion and shell 37 onto the pin 33, a wave washer 39 or other type of spring is assembled over the head portion onto the pin 33.

In use, as the connector parts are mated together, the radiused end of the pin 14 is received within the shell concavity 38 slightly compressing the spring 39 and effecting electrical contact between the pin 14 and the contact 31 through the shell 37 and the broken inwardly directed shell wall portions. In this way, the cable wires connected to the two contacts are brought into releasable interconnection. The contacts are butt connected in that there is only a surface connection and transverse movement of the pin 14 can be used to break the connection without damaging the contacts or the electrical parts. The split end of 14 provides a wiping action as the pin end engages the shell concavity 38 removing surface oxides and the like which would otherwise impair conductivity.

Figure 5:
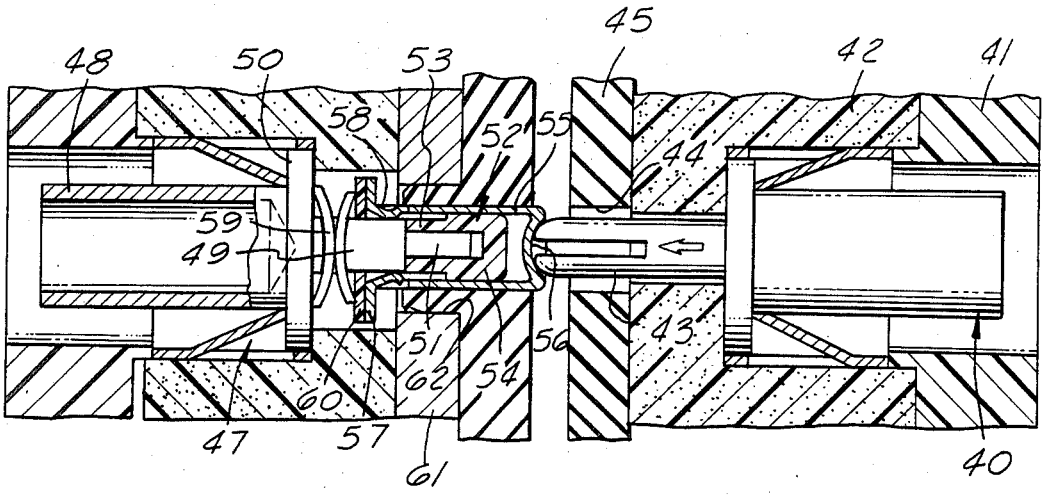
FIG. 5 is a side elevational, sectional view of a still further connector embodiment shown during mating and capable of providing EMI shielding of a connector part when unmated.
Figure 6:
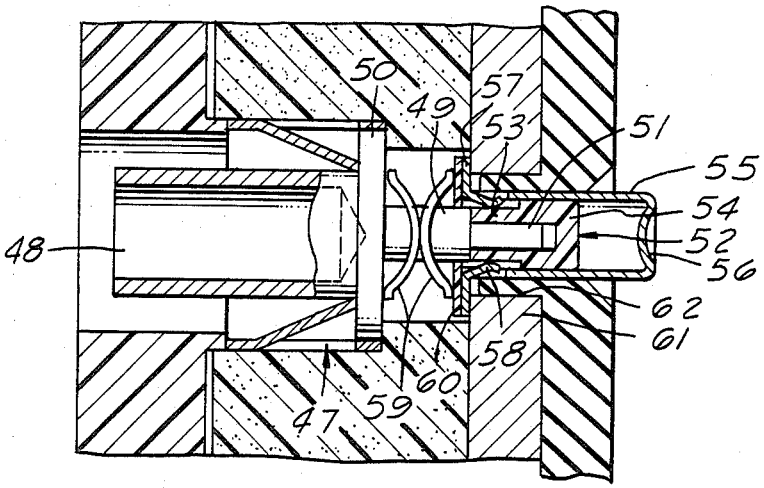
FIGS. 6 and 7 show further sectional views similar to FIG. 5 with the contact in shielding position and during mating, respectively, and utilizing different springs.
Figure 7:
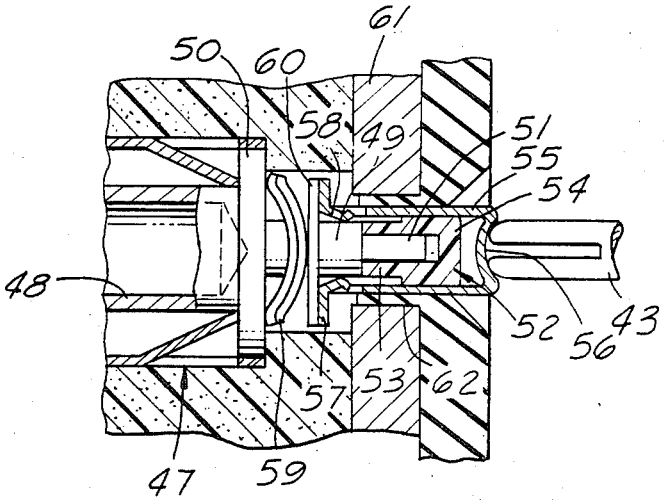
Figure 8:
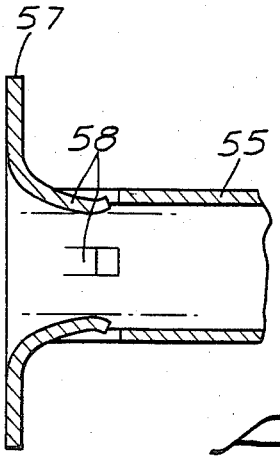
FIG. 8 is a sectional view showing details of a cylindrical shell for the contact of FIGS. 4–7.

For the ensuing description of a still further version of the invention especially adapted to effect isolation of a connector part from external electromagnetic interference fields, reference is made to FIGS. 5–7. The male contact 40 can be identical to the contact 12 of the first described embodiment and mounted within insulative inserts 41 and 42 in a connector part. The pin 43 extends into an oversize opening 44 of a resilient plastic or rubber interface seal 45.

The second contact 47 of the FIG. 5 embodiment has a generally cylindrical base including a hollow end portion 48 within which a cable wire is secured, a smaller diameter pin 49 coaxial with the end portion 48 and an enlarged flange 50 separating the pin and end portion. The outer end of the pin 49 is of even smaller diameter as enumerated at 51.

An enlarged insulating cylindrical head 52 has an axial opening enabling fitting receipt onto 51 with the head inner end face abutting the shoulder between different diameter pin parts 49 and 51. More particularly, the cylindrical head has a first part 53 which has the same inner diameter as the outer diameter of pin part 51, and a second part 54 of a larger outer diameter.

A cylindrical metal sleeve 55 is substantially identical in construction to the first described sleeve 37 in that it has a closed end 56 with a concave outwardly directed surface, and an open end defined by a circular flange 57. Broken sleeve wall portions 58 are formed inwardly to rest on the outer surface of insulative head part 53 when the sleeve is extended, and to rest on the outer surface of pin part 49 when the sleeve is retracted.

In assembly of the contact parts, spring means 59 (e.g., wave washer, coil spring) is received on the pin part 49 and pressed against flange 50. Next, an insulative washer 60 is located on the same pin part 49 followed by the sleeve 55, and the wall portions 58 which are bent inwardly to the outer surface of the head portion 53 or pin portion 49, as the case may be.

With the connector unmated (FIG. 6), the spring means 59 moves the sleeve 55 outwardly so that the sleeve flange 57 contacts the grid wall 61 adjacent an oversize opening 62 through which the sleeve extends. Since the grid wall is connected to the connector outer shell and imperforate except for the one or more openings 62, the cable wires (not shown) secured to the contact 47 are fully shielded from external electromagnetic fields. It is important to note at this time that the sleeve broken wall portions ride on the insulative head, and, therefore, there is no electrical circuit between the grid, sleeve and remainder of contact 47. Also, the insulative washer 60 prevents a short circuit between contact pin 49 and grid 61 when the connector is unmated, and also between pin 49 and male contact 14 at this time.

On mating as depicted in FIGS. 5 and 7, the male contact 40 on moving against the concave end of sleeve 55 initially breaks the contact between the sleeve flange and grid wall. After further movement the sleeve broken wall portions 58 contact the pin portion 49 and in that way interconnect the male contact 40 with the cable wires secured to contact 47.

I claim:

1. A contact for use in an electrical connector, comprising:

a generally cylindrical body having an enlarged circular flange, a hollow tubular portion extending from one face of the flange, and a pin extending from the opposite flange face;

a metal sleeve having a side wall, a closed end and an open end received upon the pin, the side wall of said sleeve being deformed inwardly at least at one point to such an extent as to provide sliding contact between the sleeve and pin; and compression spring means received on said pin contacting the flange and the sleeve.

2. A contact as in claim 1, in which the closed end of the sleeve is formed into an outwardly directed concavity.

3. A contact for use in one part of a releasable electrical connector for interconnecting pairs of cable wires, which part includes at least one such contact mounted therewithin and a metal grid plate conductively secured to a metal shell housing for the connector part, said grid plate having an opening therethrough aligned with the contact, comprising:

an open-ended metal tube for receiving a cable wire therein;

an enlarged flange secured to the metal tube opposite end;

metal pin means extending from the flange and axially aligned with the metal tube;

an enlarged insulative head affixed to the outer end of the pin means, said head having a portion immediately adjacent the pin means which has cross-sectional dimensions the same as that of the pin means;

compression spring means received on the pin means abutting against the flange;

an insulative washer received on the pin means contacting the spring means; and a hollow metal sleeve with one closed end wall and a flange on the opposite end received on the insulative head and pin means with the flange contacting the insulative washer, sleeve sidewall portions deformed inwardly to slidingly contact the insulative head portion, said spring means resiliently urging the flange into contact with the grid plate when the connector part is released.

4. A contact for use in an electrical connector, comprising:

a generally cylindrical body having an enlarged circular flange, a hollow tubular portion extending from one face of the flange, and a pin extending from the opposite flange face;

a metal sleeve having a closed end and an open end received upon the pin, sleeve walls defining the open end being formed into a radially outwardly extending flange; and compression spring means received on said pin contacting the circular flange and the sleeve flange.

5. A contact for use in an electrical connector, comprising:

a generally cylindrical body having an enlarged circular flange, a hollow tubular portion extending from one face of the flange, and a pin extending from the opposite flange face, said pin including an enlarged metal head at its outer end;

a metal sleeve having a wall, a closed end and an open end received upon the pin, portions of the wall being broken and formed inwardly to contact the pin behind the head; and compression spring means received on said pin contacting the flange and the sleeve.

6. A contact for use in an electrical connector, comprising:

a generally cylindrical body having an enlarged circular flange, a hollow tubular portion extending from one face of the flange, and a pin extending from the opposite flange face, an enlarged insulative head affixed to the end of the pin, said head having a portion formed into outer cross-sectional dimensions identical to those of the pin and coextensive with said pin;

a metal sleeve having a side wall, a closed end and an open end received upon the pin, the sleeve side wall having at least one broken portion extending inwardly for contacting the outer surfaces of the head portion and the pin;

an insulative washer located on the pin between the spring means and the sleeve open end; and compression spring means received on said pin contacting the flange and the sleeve.

* * * * *